US011459771B2

(12) United States Patent
Girnghuber et al.

(10) Patent No.: US 11,459,771 B2
(45) Date of Patent: Oct. 4, 2022

(54) FAçADE STRUCTURE AND/OR WALL STRUCTURE

(71) Applicant: Moeding Keramikfassaden GmbH, Marklkofen (DE)

(72) Inventors: Claus Girnghuber, Marklkofen (DE); Rudolf Wagner, Straubing (DE); Dietmar Müller, Frontenhausen (DE)

(73) Assignee: Moeding Keramikfassaden GmbH, Marklkofen (DE)

( * ) Notice: Subject to any disclaimer, the term of this patent is extended or adjusted under 35 U.S.C. 154(b) by 0 days.

(21) Appl. No.: 17/371,775

(22) Filed: Jul. 9, 2021

(65) Prior Publication Data

US 2022/0010560 A1 Jan. 13, 2022

(30) Foreign Application Priority Data

Jul. 10, 2020 (DE) ..... 102020118317.8

(51) Int. Cl.
*E04F 13/08* (2006.01)
*E04B 2/88* (2006.01)

(52) U.S. Cl.
CPC ..... *E04F 13/0862* (2013.01); *E04B 2/885* (2013.01); *E04F 13/0826* (2013.01); *E04F 2201/0146* (2013.01)

(58) Field of Classification Search
CPC ..... E04F 13/0862; E04F 13/0826; E04F 2201/0146; E04F 13/142; E04B 2/885; E04B 2/88; E04B 2001/3583; E04B 1/06; E04B 5/04; E04B 5/06; E04B 5/08; E04C 5/08; E04C 3/22; E04H 12/16; E01D 2101/28

(Continued)

(56) References Cited

U.S. PATENT DOCUMENTS 468,132 A * 2/1892 Dieterich ..... E04B 1/06 52/378
4,125,978 A * 11/1978 Schildge, Jr. ..... E04H 9/021 52/73

(Continued)

FOREIGN PATENT DOCUMENTS

AT 295807 B 1/1972
DE 2919706 A1 * 11/1980 ..... E04F 13/0801

(Continued)

*Primary Examiner* — Brian E Glessner
*Assistant Examiner* — Adam G Barlow
(74) *Attorney, Agent, or Firm* — Hoffmann & Baron, LLP

(57) ABSTRACT

Façade structure and/or wall structure for a building including tiles (1) and a support structure (2), in which the tiles (1) are received oriented in each case in a vertical plane. The support structure (2) has vertical tension elements (3), to which bearing bodies (4) are attached axially fixed. The vertical tension elements (3) are allocated to the tiles (1) in such a way that at least one of the vertical tension elements (3) allocated to a tile in each case passes through two holding elements (5) of the tile (1), namely a first holding element (5), which is arranged in a lower area of the tile, and a second holding element (5), which is arranged in an upper area of the tile (1). To mount the tiles on the vertical tension elements (3) it is provided that the bearing bodies (4) attached to the vertical tension elements cooperate with the holding elements (5).

15 Claims, 11 Drawing Sheets

(58) Field of Classification Search
USPC ..... 52/223.1, 223.7
See application file for complete search history.

(56) References Cited

U.S. PATENT DOCUMENTS

| | | | | |
|---|---|---|---|---|
| 5,875,595 | A * | 3/1999 | Smith | E04C 5/122 52/223.6 |
| 7,748,972 | B2 * | 7/2010 | Pellicer | B65B 31/00 425/117 |
| 11,326,353 | B2 * | 5/2022 | Nilsson | E04F 15/02033 |
| 2002/0178665 | A1 * | 12/2002 | Campbell | E04C 5/08 52/223.13 |
| 2006/0075702 | A1 | 4/2006 | Billings | |
| 2022/0127848 | A1 * | 4/2022 | Loyd | E04B 2/88 |

FOREIGN PATENT DOCUMENTS

| | | | |
|---|---|---|---|
| DE | 2919706 | A1 | 11/1980 |
| DE | 69000343 | T2 | 6/1993 |
| DE | 102019100486 | A1 | 7/2020 |
| DE | 102019100498 | A1 | 7/2020 |
| EP | 0552831 | A1 | 7/1993 |
| EP | 1180567 | A2 | 2/2002 |
| EP | 1441085 | | 7/2004 |

* cited by examiner

FAçADE STRUCTURE AND/OR WALL STRUCTURE

BACKGROUND OF THE INVENTION

The invention is based on a façade structure and/or wall structure for a building with the features of the preamble of claim 1.

Such façade structures and/or wall structures comprise a support structure with tiles received therein. The support structure has taut support cables. The tiles are held oriented in the vertical plane in the support structure with the aid of the taut support cables.

Such a façade structure is known from FR 669.554. The support structure of FR 669.554 is formed by vertical and horizontal steel cables, which have connectors at crossing points. At their vertical and horizontal outer edges, the tiles have longitudinal grooves forming an overall circumferential outer groove, in which the vertical and horizontal support cables engage. In addition, the façade tiles are supported in each case at two opposite corner points on the connecting bodies arranged at the crossing points of the steel cables.

CN 2010 80660 describes a glass façade structure, wherein glass tiles are fastened to holders supported in a carrier structure. The carrier structure is formed of crossing vertical and horizontal steel cables. Holders of the glass tiles are fastened to the steel cables. To fasten the holders to the glass tiles, the holders pass through the glass tiles at the fastening points.

CN 1048 18790 describes a façade decoration system with a carrier structure, in which parallel steel cables crossing each other are braced in a frame. Hooks, on which tiles are held, are fastened to the steel cables.

DE 1 271 363 describes a façade tile system with a carrier structure with taut wire cables. The wire cables are exclusively vertically oriented, taut wire cables. These vertically oriented wire cables are fastened directly to the building wall on separate support brackets and hold the façade tiles, since the vertical wire cables run in longitudinal grooves formed on the vertical sides of the façade tiles or in vertical cavities. In this way, the vertical support cables each hold several façade tiles arranged one above the other, wherein in each case the lower corner point and the upper corner point of the vertically taut wire cable is fastened to an angled bracket.

CN 107587684 A describes a façade structure with a support structure, which has vertically oriented steel cables as vertical carrier elements. Angle plates are fastened, in each case oriented horizontally, in parallel, with a vertical spacing from each other, to the vertically oriented steel cables via clamping connections. The angle plates are equipped with T hooks on their upper horizontal edge. They act as tile holders for the façade tiles. For this purpose, on their upper and lower edge the façade tiles have receivers, in which the T hooks engage, in order to hold the façade tiles on the angle plates. The façade tiles are arranged in a vertical plane which is arranged offset parallel with respect to the plane spanned by the vertical steel cables.

DE 29 19 706 A1 describes a façade structure in which the façade tiles are installed on vertically oriented, taut support cables. For this purpose, the façade tiles have clamp and snap-on elements on their back, through which the support cables pass.

Tile systems with flexible support structure are described in EP 2 154 302 B1 and EP 2 707 560 B1 as well as in EP 2 497 861 A1. In EP 2 154 302 B1 and EP 2 707 560 B1, the support structure is a flexible network of crossing, corrugated steel wires. The corrugated steel wires mesh with each other at the crossing points with their corrugations. The tiles each have longitudinal grooves on two opposite edges, in which the steel wires of the support structure engage. To fix the tiles, a mortar joint is provided for the wires running in the joint gaps. In EP 2 497 861 A1, the flexible support structure is formed in the manner of a chain framework, which is formed of horizontally taut parallel support cables, wherein in each case adjacent parallel support cables are connected to each other via connecting elements. The parallel support cables pass through core holes of the tiles arranged in the support structure in such a way that the tiles are held on the horizontal support cables in the manner of chain links, with the result that the tile system represents a type of foldable curtain.

SUMMARY OF THE INVENTION

The object of the invention is to create a façade structure and/or wall structure of the type mentioned at the beginning, which guarantees that the tiles are held securely in the support structure and is easy to install and inexpensive to produce.

Accordingly, these solutions are a façade structure and/or wall structure for a building, comprising tiles and a support structure, in which the tiles are received oriented in each case in a vertical plane.

The support structure is formed as a structure supported stationary, which has one or more profiled carriers supported stationary and/or a stationary wall. The support structure has vertically oriented, taut tension elements—called vertical tension elements in the following—which are mounted in bearing points, which are mounted directly or indirectly on one or more of the profiled carriers supported stationary and/or on the stationary wall.

Bearing bodies, preferably spherical bearing bodies, are attached axially fixed to the vertical tension elements. These bearing bodies form bearings for the tiles received in the support structure. The tiles are preferably ceramic tiles, preferably extruded tiles.

The tiles have holding elements, which are anchored in the tiles and through which in each case at least one of the vertical tension elements passes. The vertical tension elements are allocated to the tiles in such a way that at least one of the vertical tension elements allocated to a tile in each case passes through two holding elements of the tile, namely a first holding element, which is arranged in a lower area of the tile, and a second holding element, which is arranged in an upper area of the tile.

It is specific to the solution that the bearing bodies attached to the vertical tension elements cooperate with the holding elements anchored in the tile in a particular way, namely as per alternative (i) or as per alternative (ii).

Alternative (i) provides that the first holding element, which is arranged in the lower area of the tile, cooperates with two bearing bodies arranged with a vertical spacing from each other on the vertical tension element, since this holding element rests in a weight-supporting manner on the lower of the two bearing bodies and the upper of the two bearing bodies grips it from above in a locking manner, and that the second holding element, which is arranged in the upper area of the tile, does not cooperate with any bearing body arranged on the vertical tension element.

Alternative (ii) provides that the second holding element, which is arranged in the upper area of the tile, cooperates with two bearing bodies arranged with a vertical spacing from each other on the vertical tension element, since this holding element rests in a weight-supporting manner on the lower of the two bearing bodies and the upper of the two bearing bodies grips it from above in a locking manner, and that the first holding element, which is arranged in the lower area of the tile, does not cooperate with any of the bearing bodies arranged on the vertical tension element.

Because, in this solution, both bearing bodies arranged on the vertical tension element, which are preferably arranged with a spacing from each other, cooperate with the same holding element, namely with the holding element arranged in the lower area of the tile as per alternative (i), or cooperate with the holding element arranged in the upper area of the tile as per alternative (ii), and with the respectively other holding element through which the same allocated vertical tension element passes, no cooperation with bearing bodies attached to the vertical tension element is provided, this results in a simple installation, which can be carried out in a simple manner regardless of any manufacturing tolerances in the height dimension of the tiles.

Particularly preferred embodiments provide that the tile has two holding elements in a lower area of the tile and two holding elements in an upper area of the tile, preferably one holding element is arranged in each case in four corner areas of the tile. This can preferably be realized in the case of quadrangular tiles, in particular in the case of tiles with a rectangular outline.

A particularly simple handling during installation results when it is provided that the bearing body is formed as a spherical body. However, the bearing bodies can in principle also have a different shape. Embodiments in which the respective bearing surfaces of the bearing bodies, which cooperate directly with the holding element, are formed in such a way that bearing bodies and holding elements can be brought simply and securely into their working position, i.e. into their bearing position, during installation, are preferred.

It is specific to an alternative solution that the holding element is arranged in a horizontal receiving space formed in the tile, wherein the holding element is anchored, on its portion facing the inside of the tile, to an anchor arranged in the receiving space or to the wall of the receiving space and on its end facing outwards the holding element has a tension element gripping portion, preferably formed as a through opening, which grips on the allocated vertical tension element, preferably this passes through it.

The holding element is preferably formed as an elongate element, which can be inserted into the horizontal receiving space simply and securely during installation.

Advantageously, the holding element is formed as a profiled element, preferably as a U-shaped profiled element. With its two U arms the profiled element can engage in the horizontal receiving space and, in the area of its connecting web between the U arms, have a tension element gripping portion, preferably formed as a through opening for the vertical tension element. In preferred embodiments, it can be provided that the U-shaped profiled element has two U arms, rectangular in outline, of identical length and identical width. It can advantageously be provided that the U-shaped profiled element has an externally substantially cuboid configuration with a cross section which corresponds in a complementary manner to the clear cross section of the receiving space, wherein the receiving space is formed as a U-shaped receiving groove or as a receiving channel closed on the circumferential side about its longitudinal axis.

The profiled element, preferably also formed as a U-shaped profiled element, can also have an L-bracket-shaped configuration instead of a cuboid configuration. In this case, advantageously only one of the L arms is inserted into the horizontal receiving space and the other vertical L arm can engage in a vertical receiving groove or a vertical channel through the tile.

In the different embodiments of the holding element, which is arranged at least engaging in a horizontal receiving space, it is advantageous if it is provided that the anchor is arranged in the horizontal receiving space and its opposite ends cooperate with two holding elements, since the first of the opposite ends of the anchor acts on a portion of the holding element in the manner of an anchoring, wherein, in its tension element gripping portion, the holding element grips on the first vertical tension element, and since the second of the opposite ends of the anchor acts on the holding element in the manner of an anchoring, wherein, in its tension element gripping portion, the holding element grips on the second vertical tension element.

It can also be provided that the anchor has at least one anchoring end, which cooperates with a first portion of the holding element, forming a positive-locking and/or friction-locking connection and/or resilient snap-on connection.

With regard to the connection of the anchor to the holding element, it is advantageously possible for the anchoring end of the anchor to have a resilient portion and the first portion of the holding element to have at least one protrusion and/or at least one recess, on or in which the resilient portion of the anchoring end engages;

or vice versa, namely for the anchoring end of the anchor to have at least one protrusion and/or at least one recess and the first portion of the holding element to have a resilient portion, which engages on the at least one protrusion and/or in the at least one recess.

In a preferred development it can be provided that the anchor is formed as a double-T-shaped profile, which has a connecting web with two transverse webs at the ends of the connecting web, wherein the resilient portion is formed on the connecting web or the at least one protrusion and/or the at least one recess is or are formed on the connecting web, that, in the area of the first portion, the holding element has two U arms, on the sides of which facing away from each other or on the sides of which facing each other the at least one protrusion and/or the at least one recess or the resilient portion, respectively, are or is formed, and that the anchoring end of the anchor cooperates with the U arms of the holding element, since the connecting web of the double-T-shaped profile of the anchor engages between the U arms of the holding element and the resilient portion cooperates with the at least one protrusion and/or the at least one recess.

A further solution is formed by a subject-matter which has the features that the vertical tension elements span a vertical plane, which is formed parallel to the stationary wall of the support structure, wherein between the stationary wall and the plane spanned by the vertical tension elements several spacers are arranged, which are each anchored in the stationary wall with their end facing the stationary wall and grip on one of the vertical tension elements with their end facing the plane spanned by the vertical tension elements.

The spacers are preferably distributed uniformly over the wall in a grid arrangement, for example with a spacing which corresponds to the length dimension of the tiles. A grid dimension of 1 m is preferred. The grid dimension is preferably approximately the same in each case in both the horizontal direction and the vertical direction.

Via the spacers, vibrations perpendicular to the wall are prevented or reduced and the vertical tension elements run parallel to each other uniformly. With regard to the anchoring of the spacers on the stationary wall, wall plug-screw connections to the stationary wall can preferably be provided. With regard to the connection of the spacers with their end facing the vertical tension elements, it is advantageous if it is provided that the end of the spacer gripping on the vertical tension element has a receiver, preferably formed as a groove or hook gripping the vertical tension element from behind, through which the vertical tension element passes.

In principle, the spacers can be arranged such that they engage in each case between adjacent tiles, preferably in each case in the corner area. However, it is also possible for the spacers to be arranged concealed behind the tiles. In this respect it can be provided that the end of the spacer gripping on the vertical tension element grips on the allocated vertical tension element, engaging in an area between two vertically adjacent tiles, or grips on the allocated vertical tension element passing through the tile, engaging in an opening which is formed on a back of the tile.

In all embodiments of the solutions discussed, it is particularly advantageous if it is provided that the vertical tension elements are formed as taut support cables, preferably steel cables, or as taut tension rods or the like.

In the different subjects it can in each case advantageously be provided that two vertical tension elements are allocated to the tile, wherein the first of the vertical tension elements passes through the left lateral edge area of the tile and the second of the vertical tension elements passes through the right lateral edge area of the tile and that at least one tension element gripping portion of one or more of the holding elements anchored in the tile grips in each case on the first vertical tension element and on the second vertical tension element.

Tiles which have a rectangular outline, and have four corner areas, are particularly preferred, wherein in each case at least one tension element gripping portion of holding elements arranged in the tile grips in each of the four corner areas.

In preferred embodiments it can be provided that the support structure has exclusively vertically oriented tension elements, preferably vertically oriented support cables. However, embodiments are also possible in which horizontally oriented tension elements, preferably horizontally oriented support cables, are arranged in the support structure in addition to the vertically oriented tension elements.

Embodiments in which the tiles are formed closed on their upper horizontal edge and on their lower horizontal edge are particularly advantageous. Alternatively, however, in each case a horizontal longitudinal groove that is open outwards can also be formed on the upper horizontal edge and/or on the lower horizontal edge.

In preferred embodiments it is provided that in the area of their vertical side edges or in the area of at least one of their vertical side edges the tiles have or has in each case a longitudinal groove that is open towards the end face of the side edge in question or a through channel running parallel to it, which is formed open to the top and bottom and in each case through which one of the vertically oriented tension elements of the support structure passes, with the result that the vertically oriented tension element secures the tile against pivoting out of the vertical tile plane.

BRIEF DESCRIPTION OF THE DRAWINGS

The invention is explained further below with reference to figures.

There are shown in.

DETAILED DESCRIPTION

Figure 1A:
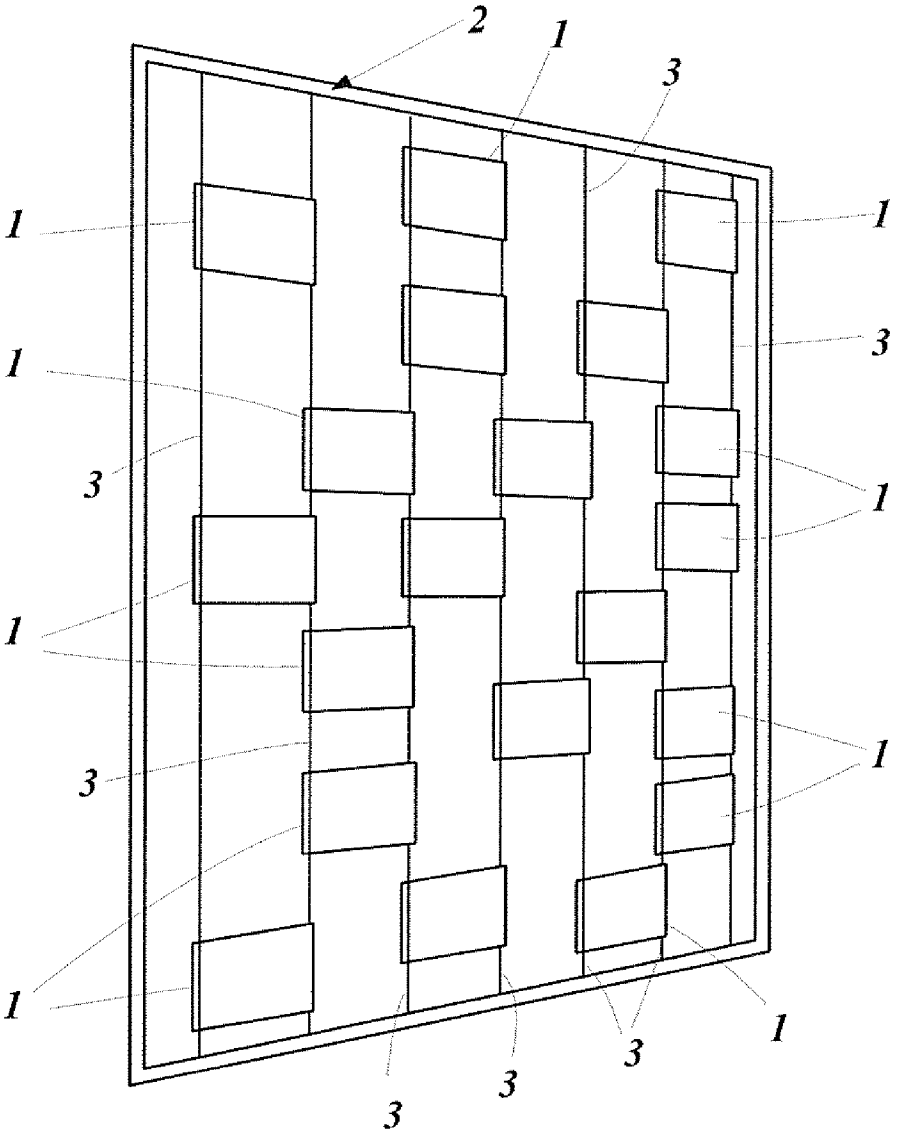
FIG. 1*a* a first embodiment example of a façade structure and/or wall structure, in front view, showing the tiles in the support structure with vertical support cables.

The support structure 2 is represented only by way of example in FIG. 1*a*. In the case represented, the support structure is made up of vertical support profiles 2*v* and horizontal support profiles 2*h*. The support profiles form a rectangular frame structure, in which the support profiles are connected to each other at the corner points.

The support structure 2 is intended for a stationary installation, namely for example in front of a building wall outside or inside a building. For this purpose, the support structure 2 can in each case be installed supported on the floor side in the area of the lower horizontal support profile 2*h* or on the roof side in the area of the upper horizontal support profile 2*h*, in stationary bearings, not represented. Alternatively or additionally, the support structure 2 can also be installed correspondingly supported stationary laterally in the area of its left and right vertical support profiles 2*v*, for example on adjoining building walls.

In each case taut support cables 3 are arranged in the support structure 2. In the embodiment examples represented in the figures, exclusively vertically oriented support cables 3 are present, and no crossing horizontal support cables.

In each case, the support cables 3 are fixed with their upper and lower ends in fastening bearings in the upper and lower horizontal support profiles 3*h*.

The embodiment examples represented in the figures are façade structures or wall structures in which in each case large-format tiles 1 are mounted in a support structure 2.

The tiles 1 are preferably ceramic tiles. In the cases represented, the tiles 1 in each case have a rectangular outline and are produced in an extrusion process. Their dimensions are preferably more than 200 mm in horizontal length and more than 100 mm in vertical height. Much larger dimensions of the tiles are conceivable. As a rule, the support structure is story-high.

Figure 1D:
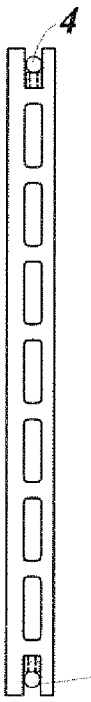
FIG. 1*d* a section view in FIG. 1*c*, in a vertical section plane.
Figure 1B:
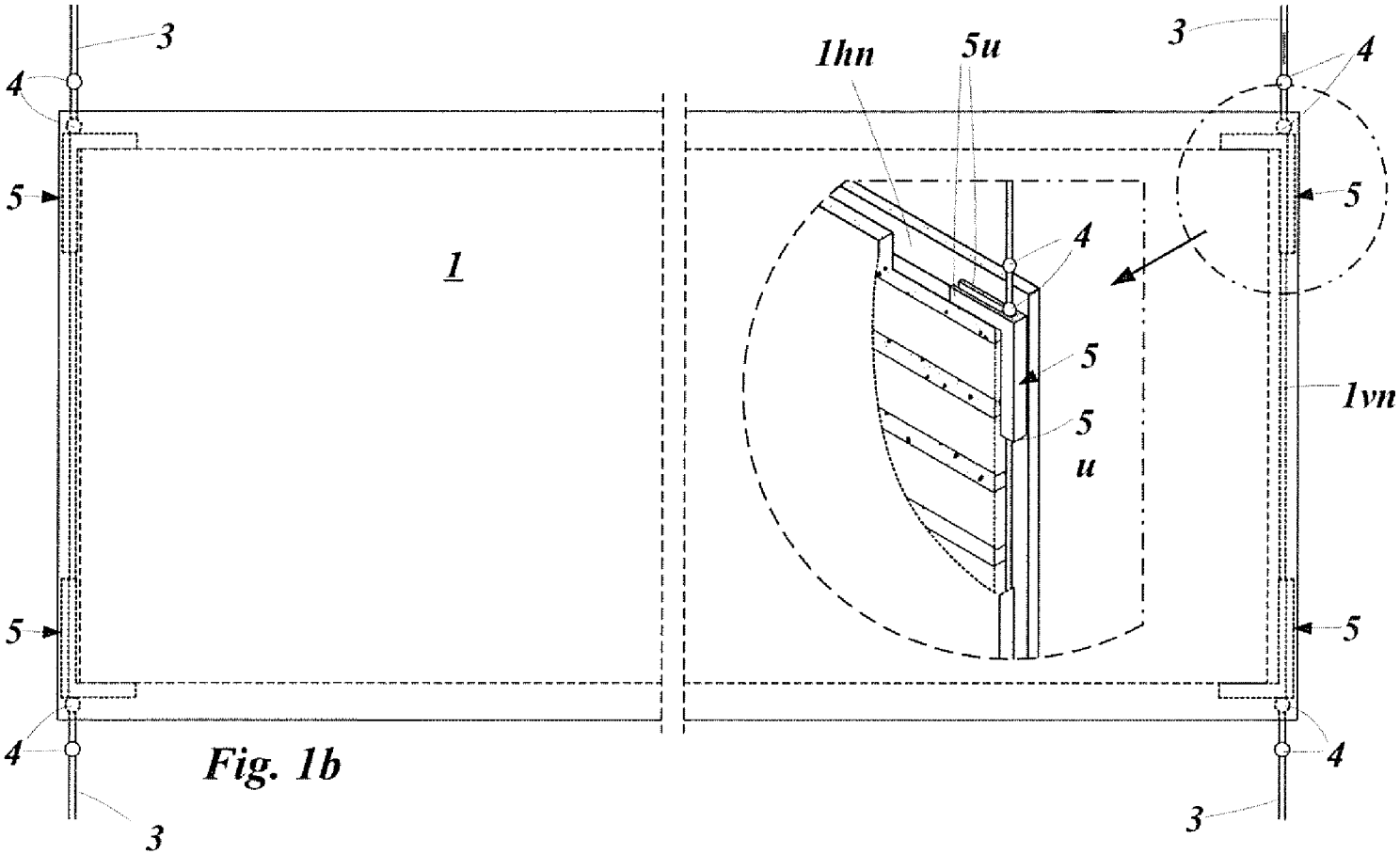
FIG. 1*b* a detail representation from FIG. 1*a*, in front view with perspective detail, showing the tiles, with L bracket holding elements inserted in the tile, on vertical support cables with spherical bearing bodies attached thereto.
Figure 1C:
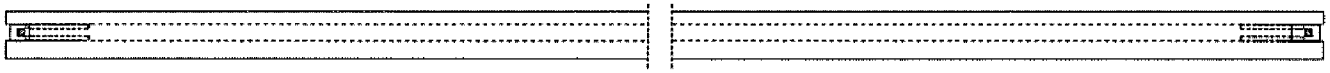
FIG. 1*c* a section view in FIG. 1*a*, in a horizontal section plane.

Reference is made to FIGS. 1*b* to 1*d* in the following:

The tiles 1 are mounted on the support cables 3. For this purpose, bearing bodies 4, on which the tiles 1 rest and/or by which the tiles 1 in the support structure are locked against pivoting out of the vertical plane, are attached axially fixed to the vertical support cables. The tiles 1 mounted in the support structure are arranged flush with each other in a common vertical plane. The common vertical plane is spanned by the support cables 3. The tiles 1, which are mounted on the support cables 3, are held in this plane by the bearing bodies 4 and by the support cables themselves, i.e. locked against pivoting out of this plane, which will be explained in more detail.

In the cases represented, the bearing bodies 4 are formed in each case as spherical bodies. They are attached axially fixed to the vertical support cables 3, for example by welding the bearing bodies to the support cables.

On their left side edge and on their right side edge the tiles 1 have in each case an open longitudinal groove 1*vn*, which extends along the vertical side edge of the tile in each case over the whole vertical extent of the tile, or of the side edge. These vertical longitudinal grooves 1*vn* have a substantially U-shaped cross section. Here, the left longitudinal groove is open towards the left end face and the right longitudinal groove is open towards the right end face. Furthermore, the longitudinal grooves 1*vn* are also open at the ends of their longitudinal extent, i.e. at the top and bottom.

The vertical support cables 3 engage in the vertical longitudinal grooves 1*vn*, since they extend in the longitudinal groove in the longitudinal direction and pass through it upwards and downwards. The bearing bodies 4 attached to the vertical support cables 3 support the tiles in all four corner points.

With regard to the supporting of the tiles 1 on the bearing bodies 4:

The mounting in a weight-supporting manner is effected primarily via the lower bearing bodies 4. In the area of their lower left corner the tiles rest in each case in a weight-supporting manner on a lower left bearing body 4 attached to the left support cable 3. In the area of its lower right corner the tile rests in a weight-supporting manner on a lower right bearing body 4 attached to the right support cable 3.

Upper bearing bodies 4 grip in the area of the upper left corner and the upper right corner, namely an upper left bearing body 4 attached to the left support cable 3 grips on the upper left corner, and an upper right bearing body 4 attached to the right support cable 3 grips in the area of the upper right corner. These upper bearing bodies 4 serve primarily to lock the tile in its vertical alignment in the common vertical plane against pivoting out of this plane.

The lower bearing bodies 4 and the upper bearing bodies 4 are formed identical, i.e. in each case as spherical bodies.

In the cases represented, the tiles 1 do not cooperate directly with the bearing bodies 4, i.e. the tiles 1 do not lie directly on the lower and upper support bodies, but in each case on holding elements 5, which are mounted supported in the tiles 1.

In the embodiment examples of FIGS. 1*b* to 1*d*, the holding elements 5 are formed as L bracket elements, which in each case are arranged inserted in the corner areas of the tiles 1. For this purpose, in addition to the longitudinal grooves 1*vn*, which are formed along the left and right vertical edges of the tiles, the tiles 1 also have horizontal longitudinal grooves on the upper horizontal edge and on the lower horizontal edge, namely a horizontal longitudinal groove 1*hn* open to the top on the upper horizontal edge, and a horizontal longitudinal groove 1*hn* open to the bottom on the lower horizontal edge.

Like the vertical longitudinal grooves 1*vn*, the horizontal longitudinal grooves 1*hn* are also U-shaped in cross section and open at the ends of their longitudinal extent.

With regard to the design of the holding elements 5:

The holding elements 5 in the embodiment example of FIGS. 1*b* to 1*d* are, as already said, L bracket elements. They are formed as special U-shaped profiles. The distinctive feature of the special U-shaped profile is in each case that the U arms 5*u* are longer in a first longitudinal portion 51 of the U-shaped profile than the U arms 5*u* in a second longitudinal portion 52 of the U-shaped profile adjoining the first longitudinal portion 51. Specifically, the U arms 5*u* in the first longitudinal portion 51 have the length L1. The U arms 5*u* in the second longitudinal portion have the length L2. The length L1 is greater than the length L2, namely in the specific case the length L1 is approx. three times greater than the length L2. As can be seen from the figures, the longitudinal extent U1 of the first longitudinal portion 51 is shorter than the longitudinal extent of the second longitudinal portion 52.

In the side view of the U-shaped profile, therefore, a substantially L-bracket-shaped configuration results, i.e. the first longitudinal portion 51 of the U-shaped profile with the U arms 5*u* of the length L1 forms the first L arm 5*s* and the second longitudinal portion 52 of the U-shaped profile with the U arms 5*u* with the length L2 forms the second L arm 5*s*. The shorter first L arm 5*s*, which is formed by the long U arms 5*u*, engages in the horizontal edge-side groove 1*hn* of the tile 1. The longer second L arm 5*s*, which is formed by the shorter U arms 5*u*, engages in the vertical edge-side groove 1*vn* of the tile 1.

The holding element 5 designed in this way is symmetrical with respect to the longitudinal center plane which runs between the U arms 5*u* parallel to the extent of the U arms. This makes it possible to arrange the holding element 5 inserted in all four corner areas in the tiles.

In the area of the upper left corner and in the area of the upper right corner, the holding element 5 is arranged inserted in the tile since the first L arm 5*s* formed by the long U arm 5*u* is pushed into the upper horizontal longitudinal groove 1*hn*, namely forming a clamping connection with the insides of the longitudinal groove. The second L arm 5*s* formed by the horizontal U arm 5*u* is inserted into the vertical longitudinal groove 1*vn* on the left and on the right side edge of the tile 1, respectively. The free ends of the short U arms stand on the floor of the vertical longitudinal groove 1*vn*, forming a receiving space for the vertical support cable 3 passing through the vertical longitudinal groove 1*vn*. The receiving space for the support cable 3 is formed by the floor of the longitudinal groove 1*vn* and by the space between the short U arm 5*u* engaging in the longitudinal groove and the floor of the U-shaped profile.

The holding elements 5 inserted in the corner areas of the tile 1 thus guarantee a stable arrangement of the vertical support cables 3 passing through the left and right longitudinal grooves 1*vn* of the tile. Furthermore, the holding elements 5 arranged in the lower left and right corner areas form bearings, with which the tiles rest in a weight-supporting manner on the bearing bodies 4 attached to the support cables 3.

The holding elements 5 arranged in the left and right upper corner areas are in contact with the upper bearing bodies 4 attached to the support cables. The bearing bodies 4 lie on the holding elements 5 inserted in the upper corner areas and thus lock the tiles in their position against pivoting out of the common vertical plane, in which the tiles are arranged flush with each other in the support structure.

Figure 2A:
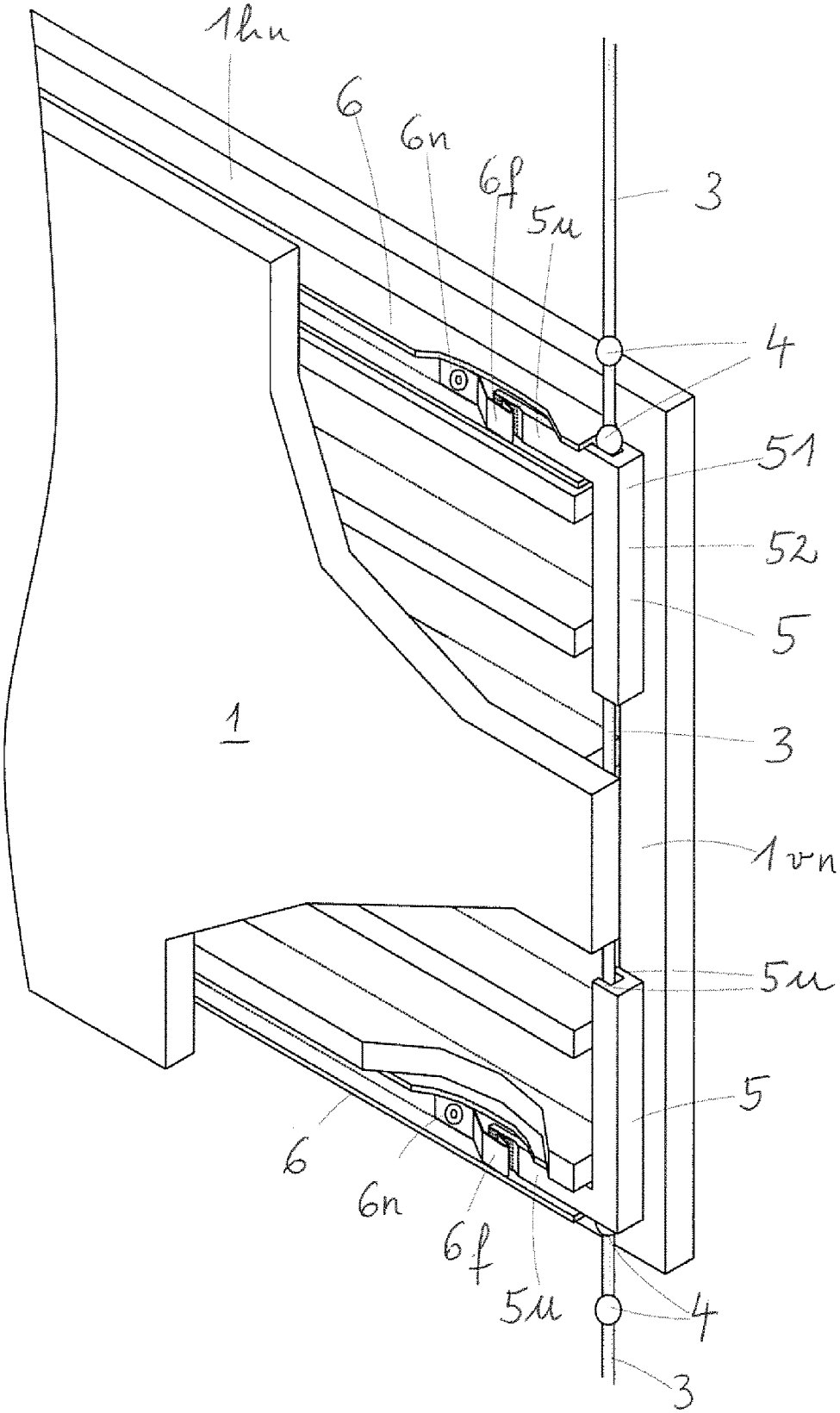
FIG. 2*a* a second embodiment example in front view with perspective detail, showing the tile, with L bracket holding elements inserted in the tile, on vertical support cables.
Figure 2C:
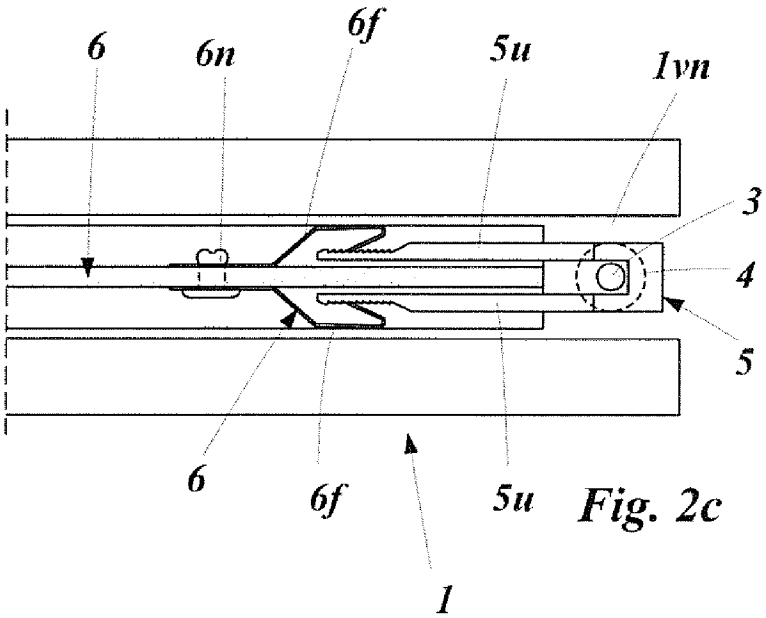
FIG. 2*c* horizontal section from FIG. 2*b;*
Figure 2B:
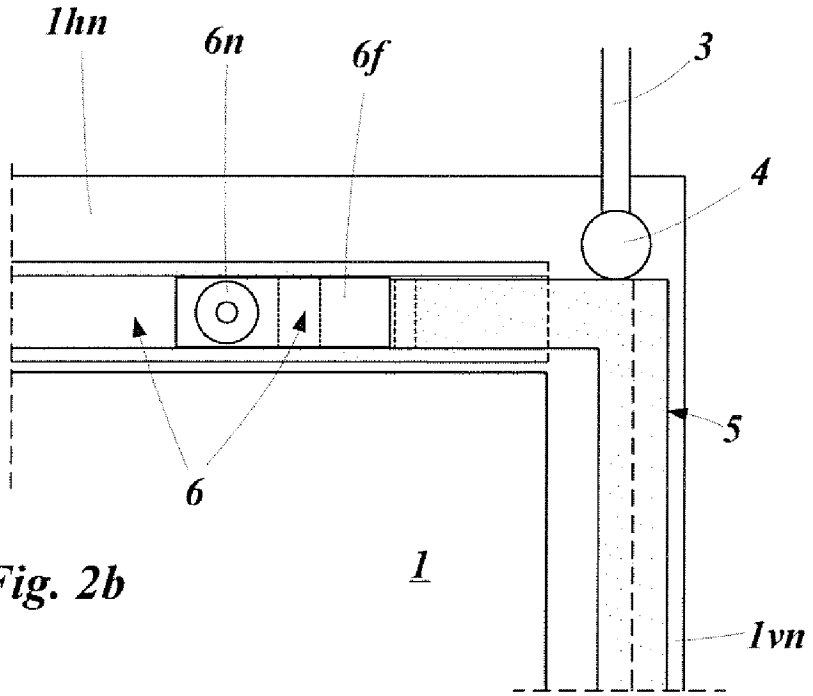
FIG. 2*b* detail representation from FIG. 2*a*, showing the L bracket holding element with anchor cut open vertically in front view.

The embodiment example of FIGS. 2*a* to 2*c* is an embodiment example modified compared with the embodiment example of FIGS. 1*a* to 1*d*. The modification consists of the fact that, in the embodiment example of FIGS. 2*a* to 2*c*, the L-bracket-shaped holding element 5 cooperates with a separate anchor 6. The anchor 6 is formed as a double-T-shaped profile, which is arranged in the horizontal receiving groove 1*hn* and cooperates with the horizontal L arm of the holding element 5. The cooperation consists of the fact that the right end of the anchor 6 represented in FIGS. 2*a* to 2*c* cooperates with the right holding element 5. With the left end of the anchor 6, not represented, which extends over the whole longitudinal extent of the tile in its horizontal groove, the anchor 6 cooperates with the left holding element 5, which is arranged in the left corner of the tile. The cooperation of the right end of the anchor 6 with the right holding element corresponds to the cooperation of the left end of the anchor 6 with the left holding element. The holding element 5 is modified compared with the holding element 5 in the embodiment example of FIGS. 1*a* to 1*d* to the effect that the long U arms, which are arranged engaging in the horizontal receiving groove 1*hn* of the tile, each have a row of saw-tooth-shaped teeth parallel to each other on their outside. Here, the parallel teeth extend in each case transverse to the longitudinal extent of the longitudinal groove 2*hn*. On its represented right anchor end and in the same way on its not represented left anchor end the anchor 6 has leaf spring mechanisms, which have leaf springs with bent end edges, which engage in the row of saw teeth on the outside of the two U arms of the holding element 5, namely gripping on the steep flank of the respective tooth in the manner of a gripping from behind.

The double-T-shaped profile has a connecting arm, on the ends of which in each case a transversely running T arm is formed. The double-T-shaped profile is arranged in the horizontal longitudinal groove 1*hn* such that the connecting web is oriented vertically and the transverse webs in the horizontal plane, i.e. parallel to the floor of the horizontal longitudinal groove 1*hn* with the U-shaped cross section. The double-T-shaped profile is arranged with its vertically running connecting web engaging between the U arms of the holding element 5. The spring mechanism 6*f* consists of two leaf springs, which form a Y configuration. The Y arms are fixed with their base portion on the double-T-shaped profile in the area of the vertically oriented connecting arm by a common fastening mechanism. The two Y arms are arranged between the lower and the upper transverse web, namely one Y arm on the left side of the connecting web and the other Y arm on the right side of the connecting web. With its chamfered free end, the left Y arm cooperates with the row of saw teeth on the outside of the left U arm of the holding element 5. With its free chamfered end, the right Y arm cooperates with the row of saw teeth on the outside of the left U arm of the holding element 5. On the not represented left end of the anchor 6, the left anchor end cooperates in the same way with the U arms of the allocated left holding element 5, i.e. the anchor is anchored with its right anchor end to the right holding element 5 and with its left anchor end to the left holding element 5. The two holding elements 5 are thus braced to each other via the anchor 6. Through this bracing of the two holding elements 5, the allocated vertical support cables 3, which pass through the vertical longitudinal grooves 1*vn* on the right and left tile edges, are braced to each other, as the right vertical support cable passes through the receiving space, which is formed between the U arms of the vertical L arm of the right holding element 5, and the left vertical support cable passes through the receiving space, which is formed by the U arms of the vertical L arm of the left holding element 5.

The two holding elements 5 arranged at the lower corners of the tile, namely the lower right holding element 5 and the lower left holding element 5, are braced to each other via an anchor 6 received in the lower horizontal receiving groove 1*hn* in the same way as the two upper holding elements 5, and correspondingly brace the two vertical support cables in this lower horizontal area.

Figure 3A:
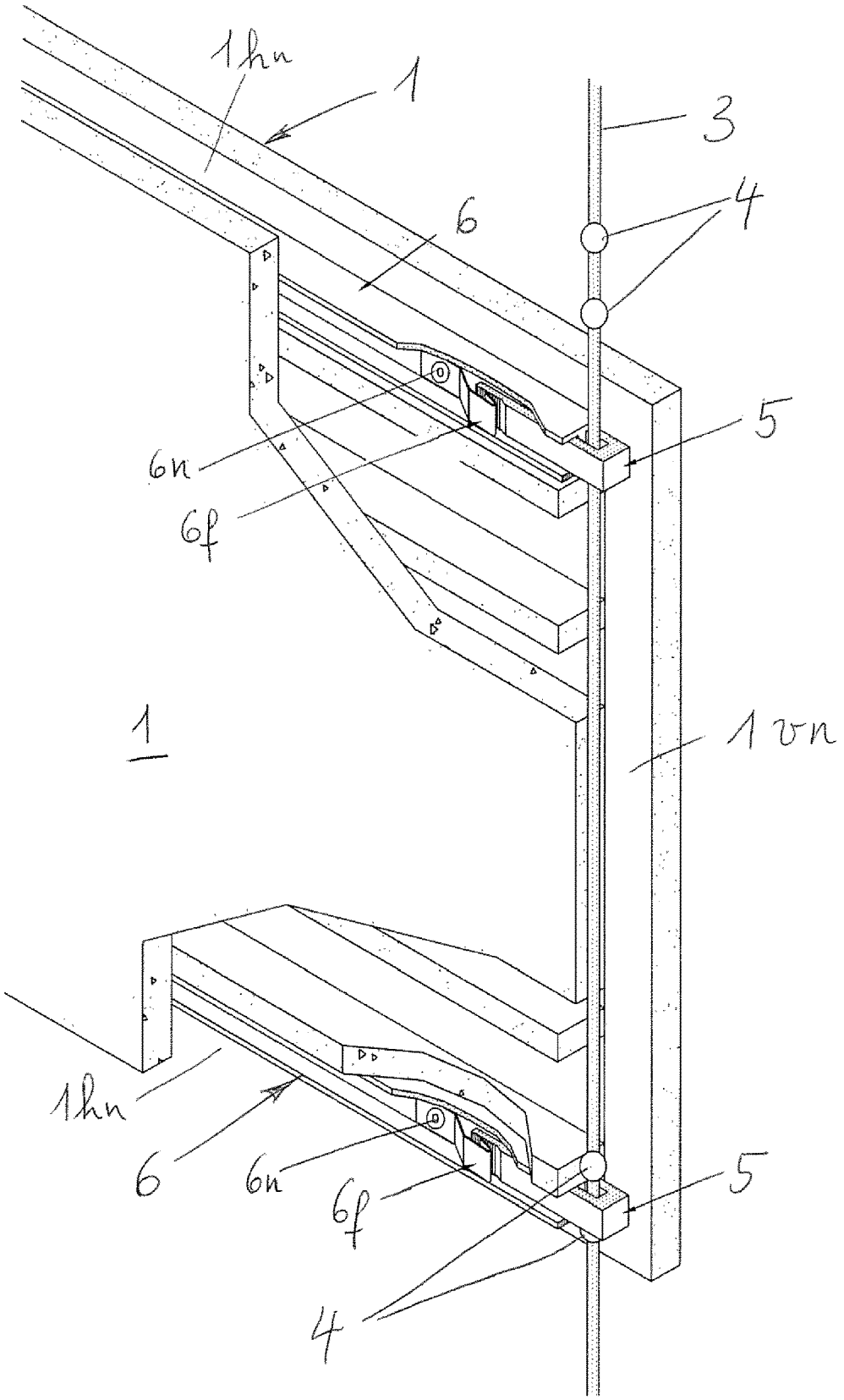
FIG. 3*a* a representation of a third embodiment example corresponding to FIG. 2*a;*

The embodiment example in FIG. 3*a* differs from the embodiment example in FIG. 2 in that the holding element 5 is not formed as an L bracket element, which is received in the vertical receiving groove 1*vn* of the tile 1 with a vertical L arm and with a horizontal L arm of the horizontal receiving groove 1*hn* of the tile 1. In contrast to this, the holding element 5 in FIG. 3*a* is formed as a U-shaped profiled element 5 with two U arms of equal length. The two arms also have an identical, constant width. The U-shaped profiled element 5 thus externally has a cuboid configuration. The U-shaped profiled element 5 is received in the horizontal receiving groove 1*hn* with both its U arms, wherein the connecting web between the two U arms is arranged, facing outwards, in the corner area of the tile 1 in which the horizontal receiving groove 1*hn* leads into the vertical receiving groove 1*vn*. Inside the U-shaped profiled element 5 between the two U arms in the area of the connecting web, a through space is formed for the vertical support cable 3. The anchoring of the U-shaped profiled element 5 in the horizontal receiving groove 1*hn* is formed the same as in FIG. 2. For this purpose, an anchor 6, which is formed identically to the anchor 6 in FIG. 2, is arranged in the horizontal receiving groove 1*hn*. The anchor 6 is formed the same as in FIG. 2, with a double-T-shaped profile. The U-shaped profiled element 5 is pushed into the double-T-shaped profile in a complementary manner. For anchoring the U-shaped profiled element 5 on the anchor 6, on their outside the two U arms of the U-shaped profiled element 5 have in each case a row of saw teeth, which is formed the same as the row of saw teeth of the holding element 5 used in FIG. 2. In the embodiment example in FIG. 3*a*, the rows of saw teeth formed on the two outsides of the U arms cooperate with the leaf spring mechanism 6*f* of the anchor 6 in the same way as in FIG. 2.

The representation in FIG. 3*a* shows the right area of the tile 1. In the lower right corner, the U-shaped profiled element 5 is installed in the lower horizontal receiving groove 1*hn*, as described above. In the upper right corner, a further U-shaped profiled element 5 is installed in the upper horizontal receiving groove 1*hn*. A vertical support cable, which passes through the upper and the lower U-shaped profiled element 5, is arranged in the vertical receiving groove 1*vn* formed in the right vertical edge of the tile 1, since it passes through the through space formed in the upper U-shaped profiled element 5 and in the lower U-shaped profiled element 5. Spherical bearing bodies 4 are attached axially fixed to the vertical support cable 3, as in the embodiment example in FIG. 2. However, the arrangement of the bearing bodies 4 on the support cable 3 is modified compared with FIG. 2 as follows: in FIG. 3*a* two bearing bodies 4 which are allocated to the right lower corner area of the tile are arranged on the support cable 3. Bearing bodies 4 which are allocated to the right upper corner area are not present on the support cable 3. In contrast thereto, in the embodiment example in FIG. 2 only one spherical bearing body 4 which is allocated to the lower right corner area of the tile and only one spherical bearing body 4 which is allocated to the upper right corner area of the tile are arranged on the support cable for the right edge area of the tile.

With regard to the function of the bearing bodies 4 in FIG. 3*a*: the lower bearing body 4 serves to support the weight of the tile 1. In the installed position, the U-shaped profiled element 5 inserted in the lower horizontal receiving groove 1*hn* lies on the lower bearing body 4. The upper spherical bearing body 4 in FIG. 3*a* serves to lock the tile 1 in the installed position. The spherical bearing body lies on the profiled element inserted in the lower horizontal receiving groove or is arranged above the U-shaped profiled element 5 with play, i.e. with a slight spacing. No bearing bodies 4 are arranged on the support cable 3 allocated to the upper corner area of the tile.

The arrangement of the bearing bodies 4 in FIG. 3*a* thus differs from the arrangement in FIG. 2 in that in FIG. 2 the lower holding element 5 and the upper holding element 5 each cooperate with one bearing body 4 and, in contrast, in FIG. 3*a* only the lower holding element, i.e. the U-shaped profiled element 5 inserted in the lower horizontal receiving groove 1*hn*, cooperates with two spherical bearing bodies 4 and the upper U-shaped profiled element 5 inserted in the upper horizontal receiving groove 2*hn* does not cooperate with a spherical bearing body 4. This applies correspondingly to the left edge area of the tile, which is not represented in FIG. 3*a*. There, the left support cable 3 arranged in the vertical receiving groove 1*vn*, which is correspondingly provided with spherical bearing bodies 4, cooperates in the same way with the U-shaped profiled elements 5 installed in the lower left corner area and in the upper left corner area as holding elements.

The arrangement of the bearing bodies 4 on the support cable results in the advantage over the arrangement in FIG. 2 that the arrangement of the bearing bodies 4, which, for supporting the weight and locking, cooperate in each case only with the holding element in the lower corner area of the tile, is no longer dependent on manufacturing tolerances in the height of the tiles.

Figure 3B:
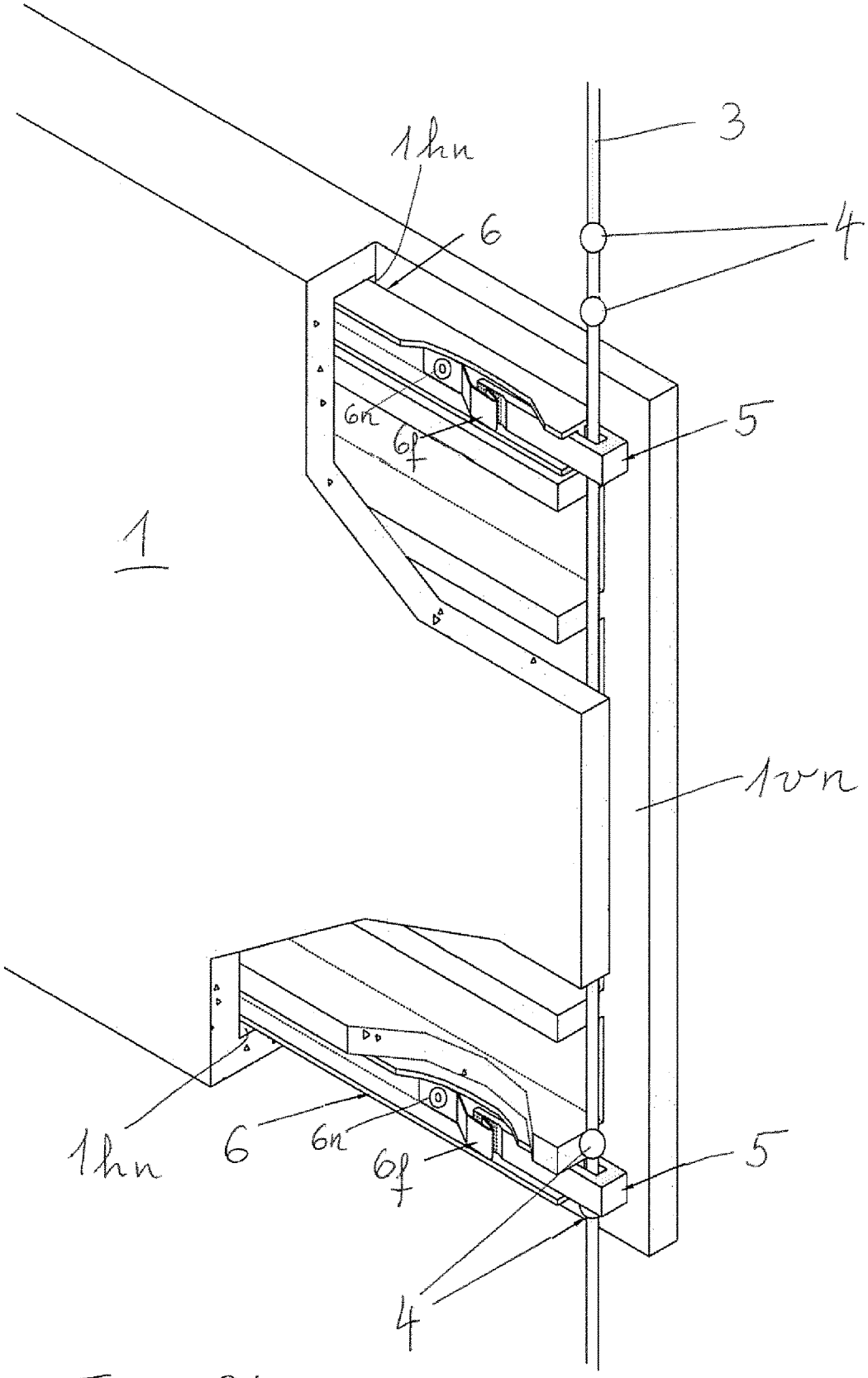
FIG. 3*b* a representation of a fourth embodiment example corresponding to FIG. 3*a;*

The embodiment example in FIG. 3*b* is modified compared with the embodiment example in FIG. 3*a*. It differs from FIG. 3*a* only in that in the embodiment example in FIG. 3*b* the upper horizontal receiving groove 1*hn* is closed to the top and the lower horizontal receiving groove 1*hn* is closed to the bottom. They thus form receiving channels closed on the circumferential side about the longitudinal axis of the receiving groove, which are open exclusively at their right and left ends. This means that the tiles 1 are closed in each case at their upper and lower edges and thus no water or dirt can penetrate there.

Figure 4A:
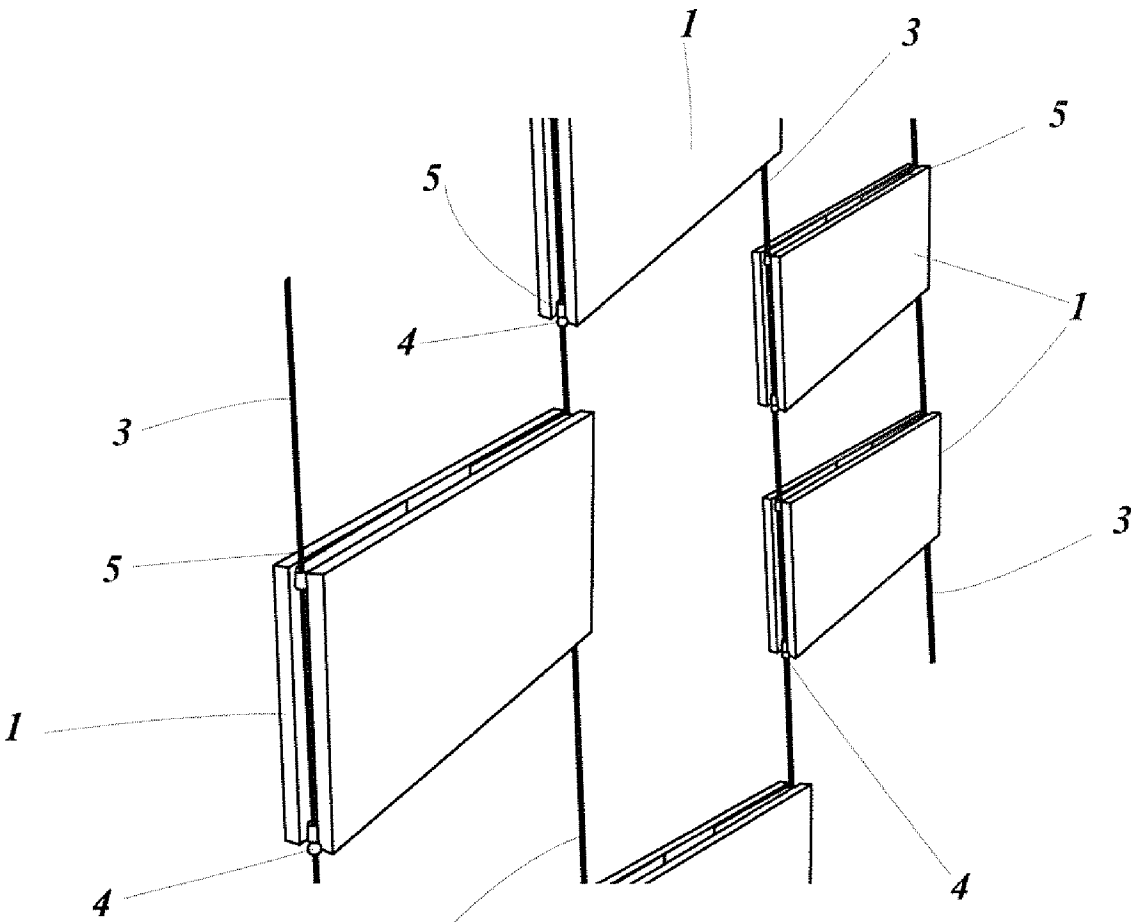
FIG. 4*a* a fifth embodiment example of a façade structure and/or wall structure, in perspective front view, showing the tiles, with clip-shaped holding elements inserted, on vertical support cables.
Figure 4B:
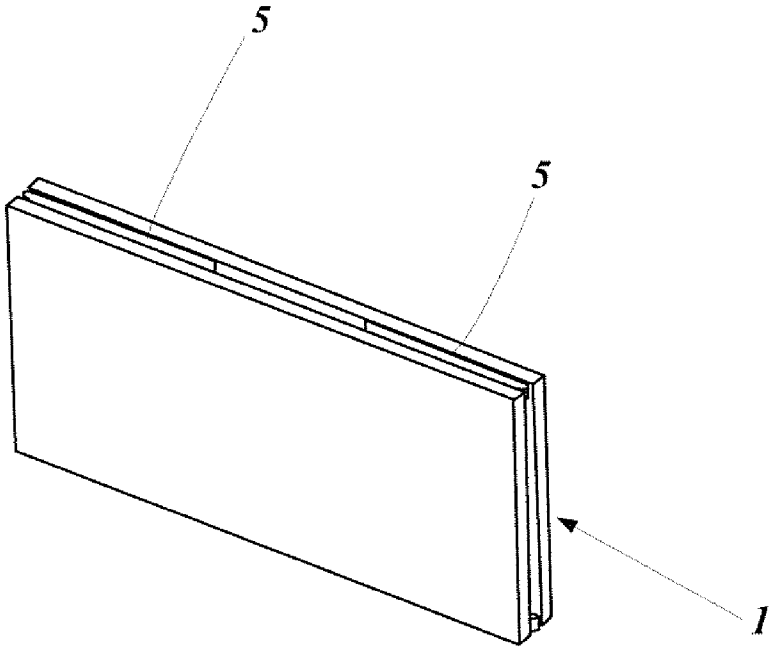
FIG. 4*b* a detail representation of a tile in FIG. 4*a*, in perspective front view, showing the tile, with clip-shaped holding elements inserted.
Figure 5B:
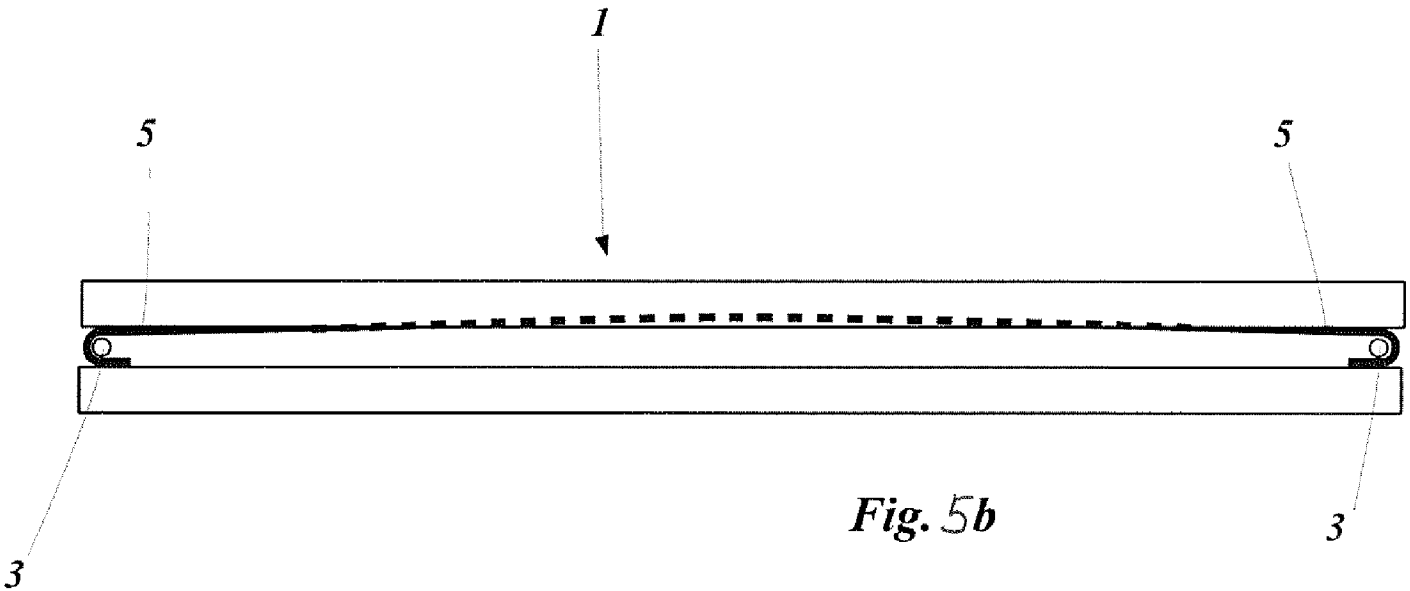
FIG. 5*b* a top view of the tile with installed holding element of FIG. 5*a;*

In the embodiment examples in FIGS. 4*a* to 4*b*, the holding elements 5 are formed deviating from the previously described design. The holding elements 5 in FIGS. 3*a* to 3*b* are formed as elongate, clip-shaped elements which extend axially, i.e. slightly curved substantially in an axial direction. In FIGS. 3*a* to 3*b*, two such holding elements 5 are inserted in the upper horizontal longitudinal groove 1*hn* of the tile 1, namely in such a way that the main longitudinal portion of the holding element 5 is arranged extending longitudinally in the left portion of the horizontal longitudinal groove, and that the free end of the holding element 5 protrudes into the left vertical longitudinal groove and there grips the vertical support cable 3 passing through the longitudinal groove from behind by means of a hook-shaped end formed on the left end of the support element 50. The right holding element 5 is correspondingly arranged in the right portion of the upper horizontal longitudinal groove 1*hn* and reaches with its free right end into the right vertical longitudinal groove. In the process, the hook-shaped free right end grips on the support cable 3 guided through in the right vertical longitudinal groove.

Two such holding elements 5 are arranged in the lower horizontal longitudinal groove 1*hn* in a corresponding manner. The left holding element is arranged with its main longitudinal portion in the left half of the lower horizontal longitudinal groove 1*hn* and engages in the left vertical longitudinal groove with its free left end, wherein the left hook-shaped free end grips on the vertical support cable 3 guided there. The right holding element 5 rests in the right half of the lower horizontal longitudinal groove 1*hn* in a corresponding manner, and grips on the vertical support cable, which passes through the right vertical longitudinal groove, with its free right hook-shaped end.

The anchoring of the holding elements 5 in the tile 1 is effected through the curved shape of the main longitudinal portion of the holding element 5 via an elastic clamping connection to the inner wall of the horizontal longitudinal groove. The curved shape is formed such that the main longitudinal portion of the holding element 5 can be pushed into the horizontal longitudinal groove only under elastic deformation and the elastic clamping connection to the inner wall of the longitudinal groove is formed there.

The free ends of the holding elements 5 gripping on the vertical support cables 3 cooperate with the bearing bodies 4 attached to the support cables. In the case of the holding elements 5 arranged in the lower horizontal longitudinal groove 1*hn*, the free end which grips on the allocated vertical support cable 3 rests on the bearing body attached to the support cable, with the result that the weight forces of the tile 1 are introduced onto this lower bearing body 4.

In the case of the holding elements 5 arranged in the upper horizontal longitudinal groove 1*hn*, the free end which grips on the allocated vertical support cable 3 rests, in contact, on the underside of the bearing body 4 attached to the support cable 3, with the result that the arrangement of the support cables 3 passing through the vertical longitudinal groove, and thus the position of the tile, is stabilized and locked by the bearing body 4.

Figure 5A:
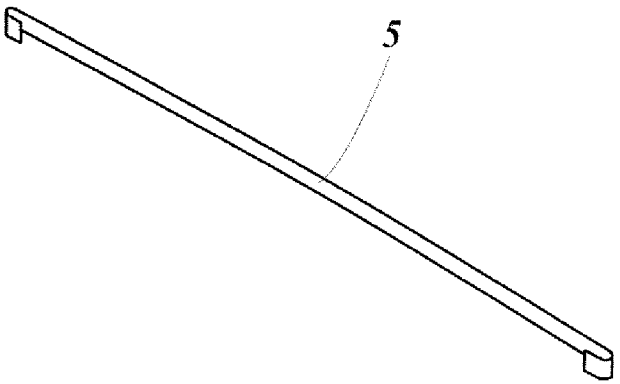
FIG. 5*a* a sixth embodiment example, in perspective detail representation, showing a clip-shaped holding element modified compared from that in FIGS. 4*a* to 4*b;*

FIG. 5*a* shows modified holding elements 5 for an embodiment example modified compared with FIGS. 3*a* to 3*b*. In the modified embodiment example of FIG. 5*a*, in contrast to the holding elements in FIGS. 3*a* to 3*b*, in each case only one holding element 5 is arranged in the upper horizontal longitudinal groove and one holding element 5 is arranged in the lower horizontal longitudinal groove. The holding element 5 corresponds in terms of its axial length to the whole longitudinal extent of the tile 1 and thus to the whole longitudinal extent of the horizontal longitudinal groove, in which the holding element 5 is received. When it is arranged in the longitudinal groove, its free left end engages in the left vertical longitudinal groove 1*vn* and there grips on the left support cable 3 guided through this vertical longitudinal groove. Its free right end engages in the right vertical longitudinal groove 1*vn* and there grips on the right support cable 3 guided through this vertical longitudinal groove. The anchoring of the holding element 5 in the longitudinal groove is effected by the curved shape of the main longitudinal portion of the holding element formed between the free ends. The anchoring is thus effected in a manner corresponding to that in the case of the previously described holding elements, namely likewise through an elastic clamping connection of the curved main portion of the holding element pushed into the longitudinal groove. Also in the case of these holding elements 5, the bearing bodies 4 attached to the vertical support cables 3 act on the tiles in the same way via the holding elements 5, i.e. the lower bearing bodies 4 act primarily in a weight-supporting manner, and the upper bearing bodies 4 act in the manner of a stabilizing and locking of the position of the tile against a pivoting of the tile out of the common vertical plane in which the tiles 1 arranged in the support structure are flush with each other.

Figure 6A:
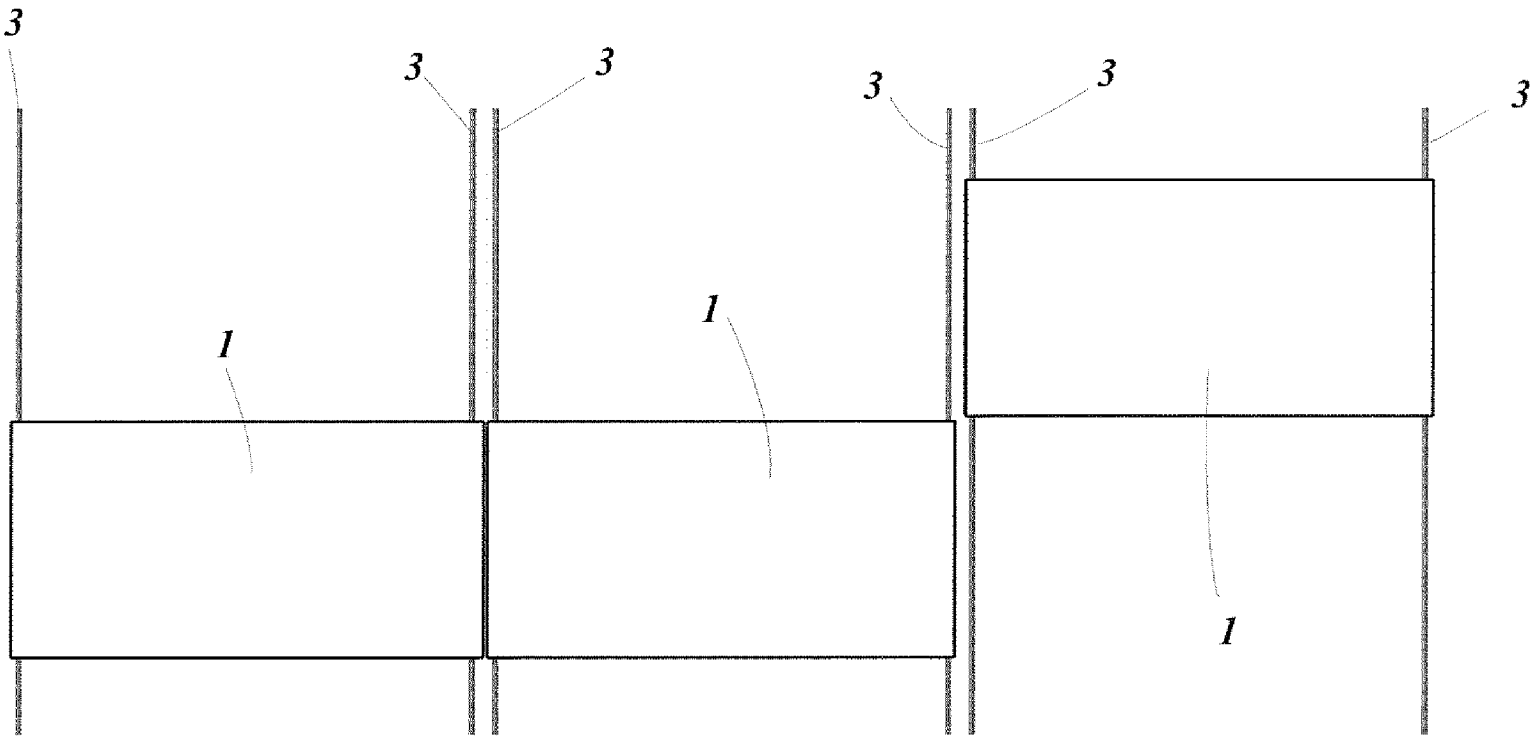
FIG. 6*a* a seventh embodiment example, in front view, showing the tiles on vertical support cables with parallel double support cables for the horizontal adjoining arrangement of adjacent tiles.

In FIG. 6*a*, the vertical support cables 3 are arranged in the support structure such that in each case a few separate left and right vertical support cables 3 are available for in each case horizontally adjacent tiles of a row. This has the result that horizontally adjacent tiles of a row can be arranged adjoining each other relatively closely depending on the arrangement of the vertical support cables. The arrangement of the six vertical support cables in FIG. 6*a* is as follows in the order from left to right:

First vertical support cable spaced apart from the second vertical support cable with spacing: tile length of the left tile Second vertical support cable spaced apart from the third vertical support cable with spacing: minimum spacing Third vertical support cable spaced apart from the fourth vertical support cable with spacing: tile length of the middle tile Fourth vertical support cable spaced apart from the fifth vertical support cable with spacing: minimum spacing Fifth vertical support cable spaced apart from the sixth vertical support cable with spacing: tile length of the right tile.

The spacing of the horizontally adjoining tiles is determined by the minimum spacing. In the case of the use of bearing elements 4, on which the tiles rest, received axially fixed on the support cables 3, this minimum spacing is determined by the diameter of a bearing body 4, or the minimum spacing is determined by the minimum receiving depth with which the vertical support cables must be received in the vertical longitudinal groove 1*vn* in order to guarantee a stable hold of the tiles in the vertical plane spanned by the vertical support cables.

Figure 7:
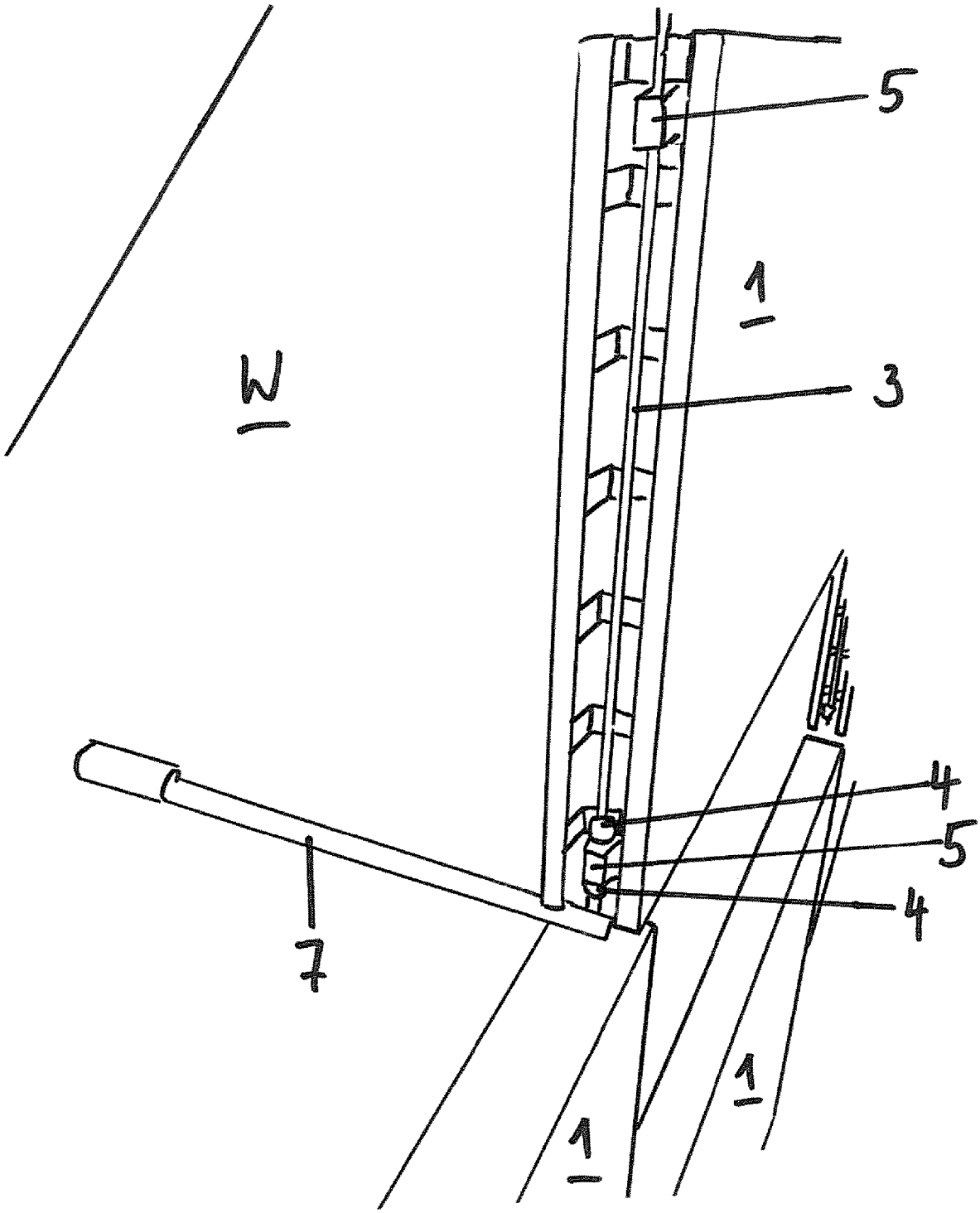
FIG. 7 a front view, which shows the tiles in the stationary support structure, not represented in more detail, in front of a stationary wall, in an eighth embodiment example.

In the representation in FIG. 7, the tiles 1 are installed in a stationary support structure, not represented in more detail, in front of a stationary wall W. In this embodiment example, in the support structure, spacers 7 distributed uniformly over the wall W are installed between the wall W and the vertical support cables 3 in order to hold the vertical support cables 3, which span a vertical plane, with a fixed spacing from the wall W. One of the spacers 7 is represented in FIG. 7. The installation of the tiles on the vertical support cables is carried out in FIG. 7 in the same manner as in the embodiment example of FIGS. 3*a* and 3*b*. The arrangement and the cooperation of the vertical support cables 3 provided with the bearing bodies 4 with the U-shaped profiled elements 5 installed in the upper and lower corner areas can be seen for the left edge area of the tile 1 in FIG. 7 on one of the tiles 1.

The structural design and the installation position of the spacer 7 can be seen from FIG. 7. The spacer is anchored in the wall W with its end facing the wall W, preferably by a wall plug-screw connection. The end of the spacer 7 facing the plane spanned by the support cables 3 grips on the vertical support cable 3 represented, namely in an area which is formed between two tiles 1 arranged one above the other in a vertically adjoining manner. For this purpose, the spacer 7 has a head, in the side of which a vertically oriented receiving groove is formed, through which the vertical support cable 3 passes. The receiving groove forms an undercut, with the result that the vertical support cable 3 is held with a fixed spacing from the stationary wall W gripped from behind. Several such spacers 7, which are not represented in FIG. 7, are present in the support structure. The spacers 7 are preferably arranged uniformly distributed over the wall W in a grid. They have the effect that the plane spanned by the vertical support cables 3 remains at a fixed spacing from the wall W and cannot make any vibrations perpendicular to the wall.

In the embodiment examples represented in the figures, ceramic tiles 1 are used which are produced in an extrusion process. The course of the upper and lower horizontal edge-side receiving spaces or grooves 1*hn* and of the further horizontal longitudinal channels in the tile represents the extrusion direction.

LIST OF REFERENCE NUMBERS

1 tile
1*vn* longitudinal groove on the vertical left and right side edge of the tile
1*hn* longitudinal groove on the upper and lower horizontal edge of the tile
2 support structure
2*h* horizontal support profile
2*v* vertical support profile
3 support cable
4 bearing body
5 holding element
5*u* U arm
5*s* L arm
51 first longitudinal portion of the U-shaped profile
52 second longitudinal portion of the U-shaped profile
6 anchor
6*f* spring mechanism
6*n* rivet connection
U1 length of the first longitudinal portion 51 of the U-shaped profile
U2 length of the second longitudinal portion 52 of the U-shaped profile
L1 length of the U arm 5*u* of the first longitudinal portion 51 of the U-shaped profile
L2 length of the U arm of the second longitudinal portion 52 of the U-shaped profile
7 spacer

What is claimed is:

1. A façade structure and/or wall structure for a building, comprising tiles and a support structure, in which the tiles are received oriented in each case in a vertical plane, wherein it is provided:

that the support structure is formed as a structure supported stationary, which has one or more profiled carriers supported stationary and/or a stationary wall, that the support structure has vertically oriented, vertical tension elements which are mounted in bearing points, which are mounted directly or indirectly on one or more of the profiled carriers supported stationary and/or on the stationary wall, that bearing bodies, which form bearings for the tiles received in the support structure, are attached axially fixed to the vertical tension elements, that the tiles have holding elements, which are anchored in the tiles and in each case through which at least one of the vertical tension elements passes, that the vertical tension elements are allocated to the tiles in such a way that at least one of the vertical tension elements allocated to a tile in each case passes through two of the holding elements of the tile, wherein the first holding element is arranged in a lower area of the tile, and the second holding element is arranged in an upper area of the tile, and wherein the bearing bodies attached to the vertical tension elements cooperate with the holding elements in such a way that the first holding element, which is arranged in the lower area of the tile, cooperates with two of the bearing bodies arranged with a vertical spacing from each other on the vertical tension element, since this holding element rests in a weight-supporting manner on the lower of the two bearing bodies and the upper of the two bearing bodies grips it from above in a locking manner, and that the second holding element, which is arranged in the upper area of the tile, does not cooperate with one of the bearing bodies arranged on the vertical tension element;

or that the second holding element, which is arranged in the upper area of the tile, cooperates with two of the bearing bodies arranged with a vertical spacing from each other on the vertical tension element, since this holding element rests in a weight-supporting manner on the lower of the two bearing bodies and the upper of the two bearing bodies grips it from above in a locking manner, and that the first holding element, which is arranged in the lower area of the tile, does not cooperate with any of the bearing bodies arranged on the vertical tension element.

2. The façade structure and/or wall structure according to claim 1, wherein the holding elements comprise two holding elements in a lower area of the tile and two holding elements in an upper area of the tile.

3. The façade structure and/or wall structure according to claim 1, wherein the bearing body is formed as a spherical body.

4. The façade structure and/or wall structure according to claim 1, wherein the vertical tension elements are formed as taut support cables.

5. A façade structure and/or wall structure for a building, comprising tiles and a support structure, in which the tiles are received oriented in each case in a vertical plane, wherein it is provided:

that the support structure is formed as a structure supported stationary, which has one or more profiled carriers supported stationary and/or a stationary wall, that the support structure has vertically oriented, vertical tension elements which are mounted in bearing points, which are mounted directly or indirectly on one or more of the profiled carriers supported stationary and/or on the stationary wall, that bearing bodies, which form bearings for the tiles received in the support structure, are attached axially fixed to the vertical tension elements, that the tiles have holding elements, which are anchored in the tiles and in each case through which at least one of the vertical tension elements passes, that the vertical tension elements are allocated to the tiles in such a way that at least one of the vertical tension elements allocated to a tile in each case passes through two of the holding elements of the tile, wherein the first holding element is arranged in a lower area of the tile, and the second holding element is arranged in an upper area of the tile, wherein each of the holding elements are arranged in a horizontal receiving space formed in the tile, wherein, on its portion facing the inside of the tile, each of the holding elements are anchored to an anchor arranged in the receiving space or to the wall of the receiving space and each of the holding elements have a tension element gripping portion, which grips on the allocated vertical tension element.

6. The façade structure and/or wall structure according to claim 5, wherein at least one of the holding elements are formed as a U-shaped profiled element which engages with two U arms in the receiving space and, the tension gripping element is positioned in the area of a connecting web between the U arms.

7. The façade structure and/or wall structure according to claim 6, wherein the U-shaped profiled element has two U arms, rectangular in outline, of identical length and identical width.

8. The façade structure and/or wall structure according to claim 6, wherein the U-shaped profiled element has a substantially cuboid configuration with a cross section which corresponds in a complementary manner to the clear cross section of the receiving space, and wherein the receiving space is formed as a U-shaped receiving groove or as a receiving channel closed on the circumferential side.

9. The façade structure and/or wall structure according to claim 5, wherein the anchor is arranged in the horizontal receiving space and its opposite ends cooperate with two of the holding elements, the vertical tension elements comprise a first vertical tension element and a second vertical tension element a first end of opposing ends of the anchor acts on a portion of the holding element in the manner of an anchoring, wherein the holding element grips on the first vertical tension element in its tension element gripping portion, and a second end of opposing ends of the anchor acts on the holding element in the manner of an anchoring, wherein the holding element grips on the second vertical tension element in its tension element gripping portion.

10. The façade structure and/or wall structure according to claim 5, wherein the anchor has at least one anchoring end, which cooperates with a first portion of the holding element, forming a positive-locking and/or friction-locking connection and/or resilient snap-on connection.

11. The façade structure and/or wall structure according to claim 10, wherein the anchoring end of the anchor has a resilient portion and the first portion of the holding element has at least one protrusion and/or at least one recess, on or in which the resilient portion of the anchoring end engages; or wherein the anchoring end of the anchor has at least one protrusion and/or at least one recess and the first portion of the holding element has a resilient portion, which engages on the at least one protrusion and/or in the at least one recess.

12. The façade structure and/or wall structure according to claim 11, wherein the anchor is formed as a double-T-shaped profile, which has a connecting web with two transverse webs at the ends of the connecting web, wherein the resilient portion is formed on the connecting web or the at least one protrusion and/or the at least one recess is or are formed on the connecting web, and wherein, in the area of the first portion, the holding element has two U arms, on the sides of which facing away from each other or on the sides of which facing each other the at least one protrusion and/or the at least one recess or the resilient portion, respectively, are or is formed, and wherein the anchoring end of the anchor cooperates with the U arms of the holding element, since the connecting web of the double-T-shaped profile of the anchor engages between the U arms of the holding element and the resilient portion cooperates with the at least one protrusion and/or the at least one recess.

13. The façade structure and/or wall structure according to claim 1, wherein the vertical tension elements span a vertical plane, which is formed parallel to the stationary wall of the support structure, and wherein, between the stationary wall and the plane spanned by the vertical tension elements, several spacers are arranged, which are each anchored in the stationary wall with their end facing the stationary wall and grip on one of the vertical tension elements with their end facing the plane spanned by the vertical tension elements.

14. The façade structure and/or wall structure according to claim 13, wherein the end of the spacer gripping on the vertical tension element has a receiver, through which the vertical tension element passes.

15. The façade structure and/or wall structure according to claim 13, wherein the end of the spacer gripping on the vertical tension element grips on the allocated vertical tension element, engaging in an area between two vertically adjacent tiles, or grips on the allocated vertical tension element passing through the tile, engaging in an opening which is formed on a back of the tile.

* * * * *